US011837834B2

(12) United States Patent
Hamada et al.

(10) Patent No.: US 11,837,834 B2
(45) Date of Patent: Dec. 5, 2023

(54) CONNECTOR STRUCTURE, AND CONNECTOR STRUCTURE MANUFACTURING METHOD

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Kazuaki Hamada, Mie (JP); Atsushi Murata, Mie (JP); Junichi Ono, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 260 days.

(21) Appl. No.: 17/312,676

(22) PCT Filed: Dec. 3, 2019

(86) PCT No.: PCT/JP2019/047256
§ 371 (c)(1),
(2) Date: Jun. 10, 2021

(87) PCT Pub. No.: WO2020/129623
PCT Pub. Date: Jun. 25, 2020

(65) Prior Publication Data

US 2022/0069533 A1 Mar. 3, 2022

(30) Foreign Application Priority Data

Dec. 21, 2018 (JP) ..... 2018-239930

(51) Int. Cl.
*H01R 43/048* (2006.01)
*H01R 13/6592* (2011.01)
(Continued)

(52) U.S. Cl.
CPC ..... *H01R 43/048* (2013.01); *H01R 13/6592* (2013.01); *H01R 24/40* (2013.01);
(Continued)

(58) Field of Classification Search
CPC .. H01R 43/048; H01R 13/6592; H01R 24/40; H01R 24/60; H01R 2101/00; H01R 2105/00
(Continued)

(56) References Cited

U.S. PATENT DOCUMENTS 7,249,970 B1 7/2007 Wei
7,390,221 B2 * 6/2008 Akino ..... H01R 9/0518 439/607.17
(Continued)

FOREIGN PATENT DOCUMENTS

DE 60035383 T2 * 3/2008 ..... H01R 9/0518
EP 1174949 A1 * 1/2002 ..... H01R 9/0518
(Continued)

OTHER PUBLICATIONS

International Search Report dated Feb. 10, 2020 for WO 2020/129623 A1 (4 pages).

*Primary Examiner* — Peter G Leigh
(74) *Attorney, Agent, or Firm* — Venjuris, P.C.

(57) ABSTRACT

A female connector structure is provided with a shielded cable configured such that an outer periphery of a coated wire including a core and an insulation coating is surrounded by a braided wire, a female terminal including a wire barrel to be connected to the core and a connecting tube portion and to be connected to a mating terminal, an insulating
(Continued)

dielectric for surrounding an outer periphery of the connecting tube portion of the female terminal, a rear outer conductor including a shield connecting portion to be electrically connected to the braided wire and a dielectric crimping portion to be crimped to at least a part of the dielectric from outside, and a front outer conductor including a front tube portion for surrounding an outer periphery of the dielectric and a rear outer conductor locking portion for locking at least a part of the dielectric crimping portion from outside.

6 Claims, 19 Drawing Sheets

(51) Int. Cl.
*H01R 24/40* (2011.01)
*H01R 24/20* (2011.01)
*H01R 101/00* (2006.01)
*H01R 105/00* (2006.01)

(52) U.S. Cl.
CPC ..... *H01R 24/20* (2013.01); *H01R 2101/00* (2013.01); *H01R 2105/00* (2013.01)

(58) Field of Classification Search
USPC ..... 439/578
See application file for complete search history.

(56) References Cited

U.S. PATENT DOCUMENTS

| | | | | |
|---|---|---|---|---|
| 7,500,878 | B2 * | 3/2009 | Akino | H01R 9/0518 439/607.41 |
| 9,667,000 | B1 * | 5/2017 | Morello | H01R 24/38 |
| 9,673,578 | B1 * | 6/2017 | Lane | H01R 13/631 |
| 9,787,017 | B1 * | 10/2017 | Lane | H01R 9/0518 |
| 9,929,519 | B1 * | 3/2018 | Hall | H01R 4/2454 |
| 10,348,044 | B2 | 7/2019 | Surer | |
| 10,741,977 | B2 | 8/2020 | Maesoba et al. | |
| 2009/0035990 | A1 * | 2/2009 | McCarthy | H01R 9/0518 439/585 |
| 2011/0028034 | A1 | 2/2011 | Morikawa | |

FOREIGN PATENT DOCUMENTS

| | | | | |
|---|---|---|---|---|
| JP | 2006024499 | A * | 1/2006 | |
| JP | 2009054461 | A * | 3/2009 | H01R 4/185 |
| JP | 2010277880 | A * | 12/2010 | |
| JP | 2011-009111 | A | 1/2011 | |
| JP | 2011009111 | A * | 1/2011 | |
| JP | 5275138 | B2 * | 8/2013 | |
| JP | 2014-232585 | A | 12/2014 | |
| JP | 2014232585 | A * | 12/2014 | |

* cited by examiner

CONNECTOR STRUCTURE, AND CONNECTOR STRUCTURE MANUFACTURING METHOD

CROSS REFERENCE TO RELATED APPLICATIONS

This application is a national phase of PCT application No. PCT/JP2019/047256, filed on 3 Dec. 2019, which claims priority from Japanese patent application No. 2018-239930, filed on 21 Dec. 2018, all of which are incorporated herein by reference.

TECHNICAL FIELD

A technique disclosed in this specification relates to a connector structure formed by connecting a connector to a shielded cable and a connector structure manufacturing method.

BACKGROUND

A connector structure formed by connecting a connector to an end of a coaxial cable is known from International Publication Pamphlet No. WO 2017/144070. This connector structure includes an inner conductor, a dielectric for surrounding the inner conductor, a contact member for surrounding the outer periphery of the dielectric and a connecting member to be connected to a shield portion of a coaxial cable. A front end part of the connecting member is welded to a rear end part of the contact member while being externally fit. In this way, the contact member and the connecting member are electrically connected.

PRIOR ART DOCUMENT

Patent Document

Patent Document 1: International Publication Pamphlet No. WO 2017/144070

SUMMARY OF THE INVENTION

Problems to be Solved

However, according to the above configuration, the contact member and the connecting member are welded with the dielectric accommodated inside the contact member. Thus, troubles such as the deformation of the dielectric may occur due to heat at the time of welding the contact member and the connecting member.

The technique disclosed in this specification was completed on the basis of the above situation and aims to provide a connector structure in which the occurrence of troubles in a dielectric due to heat is suppressed.

Means to Solve the Problem

The technique disclosed in this specification is directed to a connector structure with a shielded cable configured such that an outer periphery of a coated wire including a core extending in a front-rear direction and an insulation coating surrounding an outer periphery of the core is surrounded by a shield portion, an inner conductor including a core connecting portion to be connected to the core and a connecting portion continuous with the core connecting portion and to be connected to a mating terminal, an insulating dielectric for surrounding at least an outer periphery of the connecting portion of the inner conductor, a rear outer conductor including a shield connecting portion to be electrically connected to the shield portion and a dielectric crimping portion to be crimped to at least a part of the dielectric from outside, and a front outer conductor including a tube portion for surrounding an outer periphery of the dielectric and a rear outer conductor locking portion for locking at least a part of the dielectric crimping portion from outside.

Further, the technique disclosed in this specification is directed to a connector structure manufacturing method with a step of exposing a core by stripping a front end part of an insulation coating of a shielded cable configured such that an outer periphery of a coated wire including the core extending in a front-rear direction and the insulation coating surrounding an outer periphery of the core is surrounded by a shield portion, a step of arranging an inner conductor in an insulating dielectric with a core connecting portion exposed, a step of connecting the core connecting portion of the inner conductor to the core exposed from the insulation coating, a step of connecting a rear outer conductor to the shield portion, a step of crimping a dielectric crimping portion of the rear outer conductor to at least a part of the dielectric from outside, a step of accommodating the dielectric inside a front outer conductor, and a step of locking a rear outer conductor locking portion provided on the front outer conductor to at least a part of the dielectric crimping portion.

According to the above technique, the rear and front outer conductors are connected by crimping the dielectric crimping portion of the rear outer conductor to at least a part of the dielectric and locking the rear outer conductor locking portion to at least a part of the dielectric crimping portion. Since the rear and front outer conductors can be connected without heating in this way, the occurrence of troubles in the dielectric due to heat can be suppressed.

The following modes are preferable as embodiments of the technique disclosed in this specification.

The rear outer conductor locking portion includes a rear outer conductor crimping piece to be crimped to wind around an outer periphery of the dielectric crimping portion.

According to the above configuration, the rear and front outer conductors can be reliably connected.

The rear outer conductor locking portion is provided with an expansion suppressing portion projecting toward the dielectric crimping portion with the rear outer conductor locking portion crimped to the outer periphery of the dielectric crimping portion, and the expansion suppressing portion is fit into a recess provided in the dielectric crimping portion and locked to an inner wall of the recess in a circumferential direction of the dielectric.

According to the above configuration, since the expansion suppressing portion is locked to the inner wall of the recess in the circumferential direction of the dielectric, the expansion deformation of the rear outer conductor locking portion can be suppressed.

One of the rear outer conductor locking portion and the dielectric crimping portion is provided with a connecting protrusion projecting toward the other.

According to the above configuration, the rear and front outer conductors can be reliably electrically connected by the contact of the connecting protrusion provided on one of the rear outer conductor locking portion and the dielectric crimping portion with the other. In this way, the electrical connection reliability of the rear and front outer conductors can be improved.

A locking projection provided on one of the dielectric and the dielectric crimping portion and a locking recess provided in the other are fit with the dielectric crimping portion crimped to the dielectric.

According to the above configuration, the rear outer conductor and the dielectric can be positioned in the front-rear direction. In this way, the positional accuracy of components constituting the connector structure can be improved.

Effect of the Invention

According to the technique disclosed in this specification, the occurrence of troubles in a dielectric due to heat can be suppressed.

DETAILED DESCRIPTION TO EXECUTE THE INVENTION

First Embodiment

Figure 1:
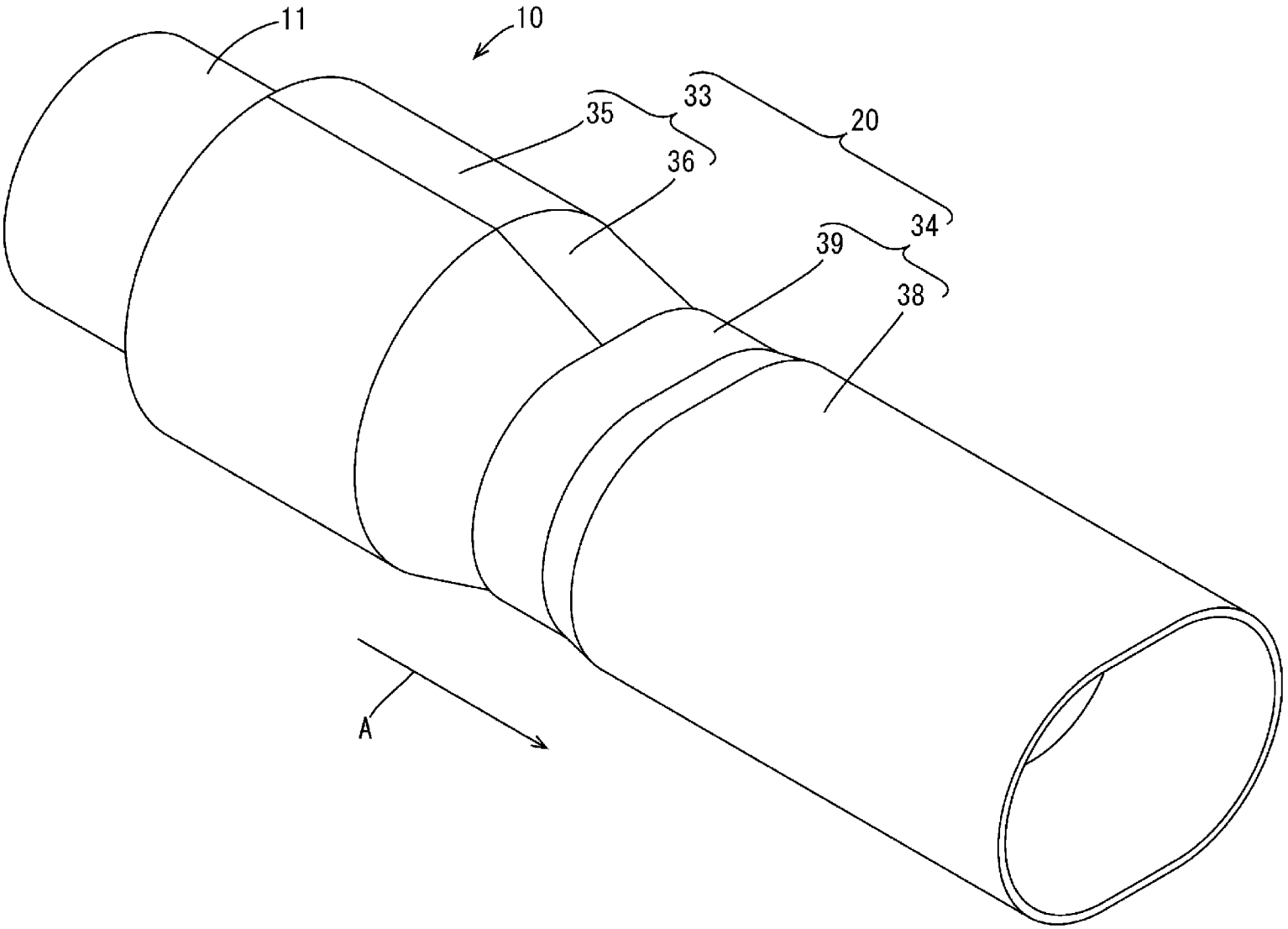
FIG. 1 is a perspective view showing a female connector structure according to a first embodiment.

A first embodiment of the technique disclosed in this specification is described with reference to FIGS. 1 to 10. A female connector structure 10 according to this embodiment is formed by connecting a female connector 12 to an end of a shielded cable 11. The female connector 12 includes female terminals 18 (example of an inner conductor), a dielectric 19, a rear outer conductor 33 and a front outer conductor 34. In the following description, an extending direction (direction indicated by an arrow A) of the shielded cable 11 is referred to as a forward direction. Further, only some of a plurality of identical members may be denoted by a reference sign and the other members may not be denoted by the reference sign.

[Shielded Cable 11]

Figure 2:
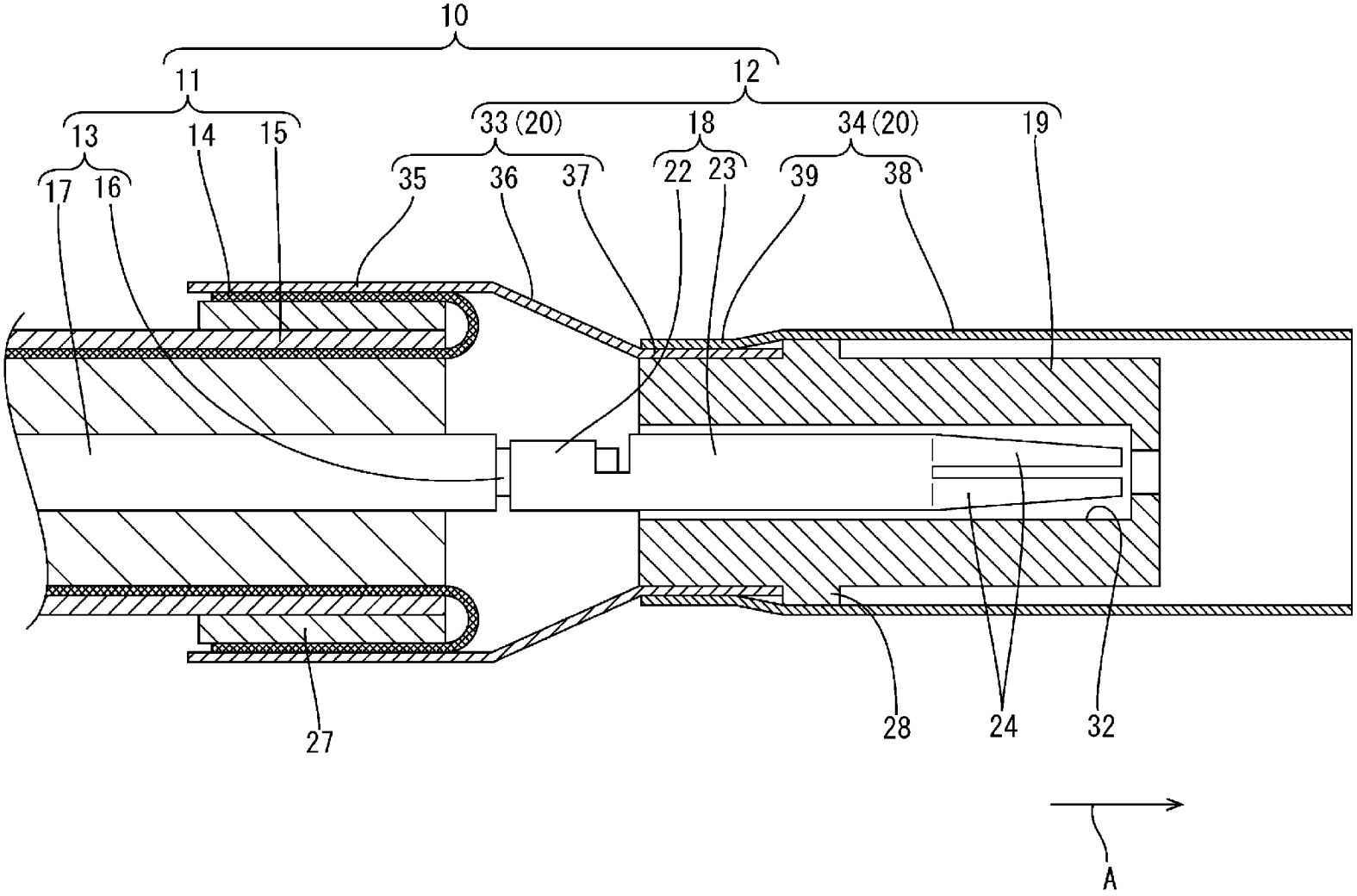
FIG. 2 is a section showing the female connector structure.

As shown in FIG. 2, the shielded cable 11 is configured such that the outer peripheries of a plurality of (two in this embodiment) coated wires 13 are surrounded by a braided wire 14 (example of a shield portion) made of metal thin wires and the outer periphery of the braided wire 14 is surrounded by a sheath 15 made of an insulating material. Each coated wire 13 includes a core 16 and an insulation coating 17 surrounding the outer periphery of the core 16. An arbitrary metal such as copper, copper alloy, aluminum or aluminum alloy can be selected as a metal constituting the core 16 according to need. The core 16 may be formed by one metal strand or may be formed by a stranded wire formed by twisting a plurality of metal strands. The insulation coatings 17 and the sheath 15 are made of insulating synthetic resin.

An end processing such stripping is applied to an end of the shielded cable 11 to expose an end of each of the cores 16, the insulation coatings 17 and the braided wire 14.

[Female Connector 12]

The female connector 12 includes the female terminals 18 (example of the inner conductor), the insulating dielectric 19 for surrounding the outer peripheries of the female terminals 18 and an outer conductor 20 for surrounding the outer periphery of the dielectric 19. The outer conductor 20 includes the rear outer conductor 33 and the front outer conductor 34 electrically connected to a front end part of the rear outer conductor 33.

[Female Terminals 18]

Figure 6:
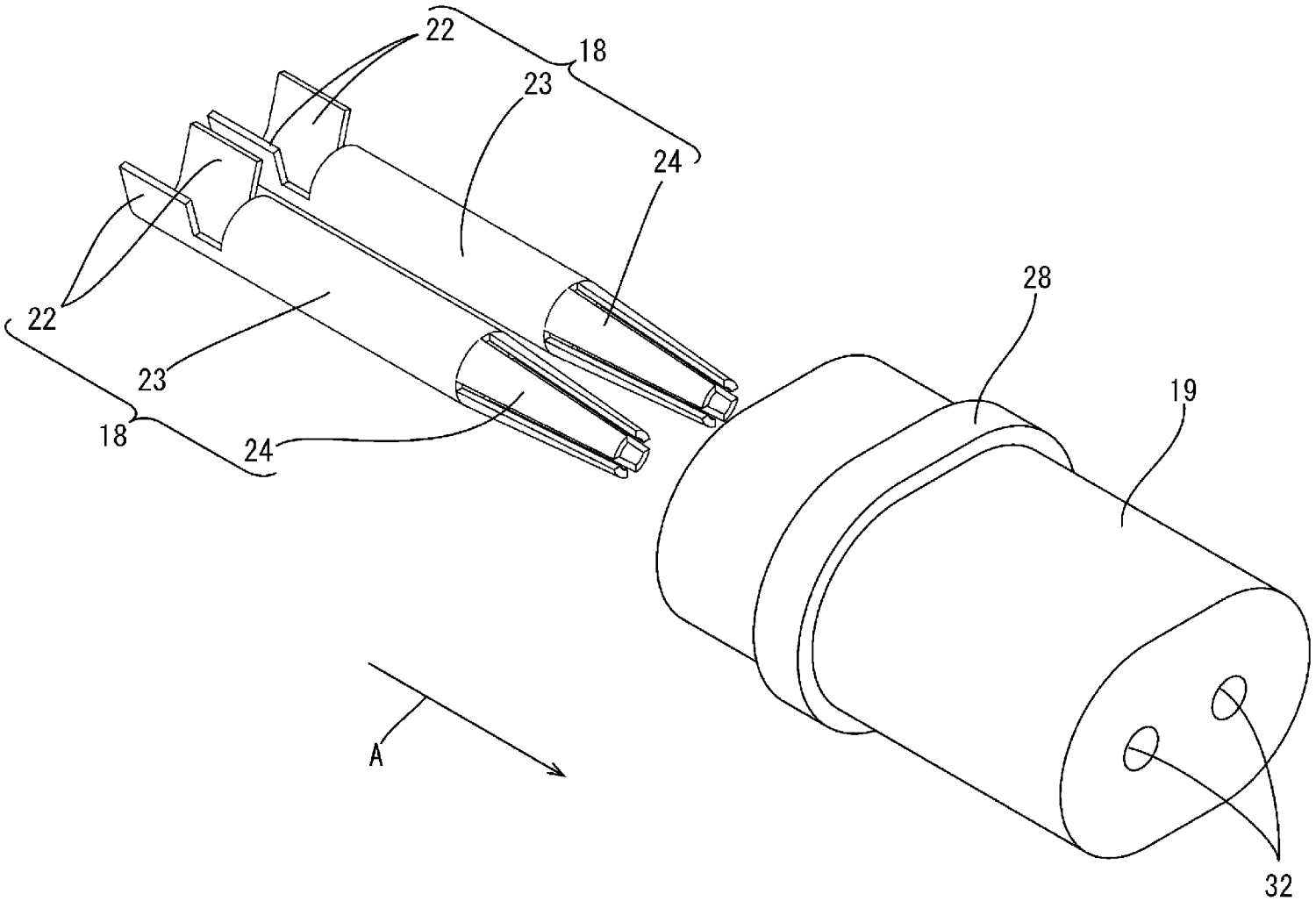
FIG. 6 is a perspective view showing a step of inserting female terminals into a dielectric.

As shown in FIG. 6, the female terminal 18 is formed by press-working a metal plate material into a predetermined shape. An arbitrary metal such as copper, copper alloy, aluminum or aluminum alloy can be selected as a metal constituting the female terminal 18 according to need. The female terminal 18 is connected to the end of each coated wire 13. The female terminal 18 includes a wire barrel 22 (example of a core connecting portion) to be crimped to wind around the outer periphery of the core 16 and a connecting tube portion 23 (example of a connecting portion) connected in front of the wire barrel 22, an unillustrated mating terminal being inserted into the connecting tube portion 23.

The connecting tube portion 23 is formed with a plurality of slits extending rearward from a front end part of the connecting tube portion 23, thereby providing a plurality of resilient contact pieces 24 extending in a front-rear direction. The plurality of resilient contact pieces 24 are reduced in diameter toward a front side and formed to be resiliently deformable in a radial direction of the connecting tube portion 23. By inserting the mating terminal into the connecting tube portion 23, the mating terminal and the resilient contact pieces 24 resiliently contact, whereby the mating terminal and the female terminal 18 are electrically connected.

[Braided Wire 14]

The braided wire 14 is formed by braiding a plurality of metal thin wires into a tube. A part of the braided wire 14 exposed from the end of the sheath 15 is folded toward an end of the sheath 15 and overlapped on the outside of a sleeve 27 described below.

[Sleeve 27]

The annular sleeve 27 is externally fit to the outside of the end of the sheath 15. As described above, the braided wire 14 is overlapped on the outside of the sleeve 27. The sleeve 27 according to this embodiment is formed into a substantially annular shape by crimping an elongated metal plate material to wind around the outer periphery of the sheath 15.

[Dielectric 19]

Figure 7:
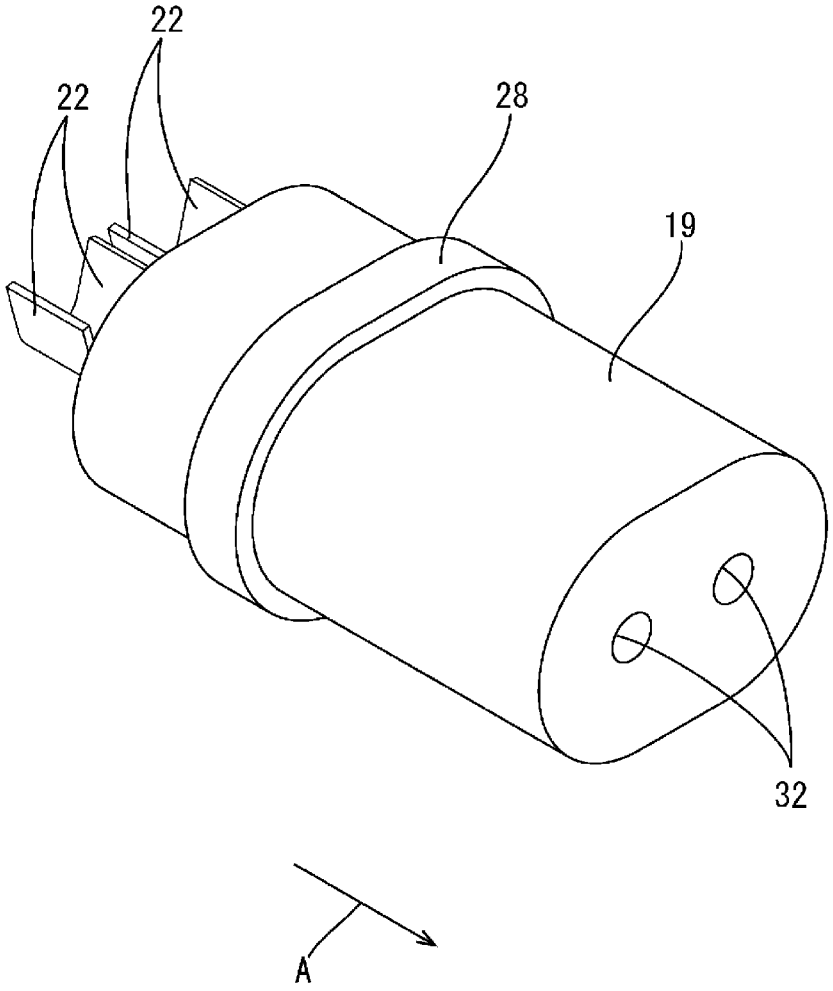
FIG. 7 is a perspective view showing a state where the female terminals are inserted in the dielectric.

As shown in FIG. 2, the connecting tube portion 23 of the female terminal 18 is surrounded around by the dielectric 19. The dielectric 19 is formed by injection molding using an insulating synthetic resin. The wire barrel 22 projects rearward from a rear end part of the dielectric 19. As shown in FIGS. 6 and 7, the dielectric 19 extends in the front-rear direction as a whole and has an oval cross-sectional shape elongated in a lateral direction.

The dielectric 19 is formed with a plurality of (two in this embodiment) cavities 32 which are arranged side by side in the lateral direction and open in the front-rear direction and into which the connecting tube portions 23 of the female terminals 18 are respectively accommodated. The mating terminal is inserted through a front opening of the cavity 32. The wire barrel 22 is drawn out rearward as described above through a rear opening of the cavity 32.

A flange 28 projecting radially outwardly of the dielectric 19 is formed on substantially one-third part of the dielectric 19 from the rear end part in the front-rear direction.

[Rear Outer Conductor 33]

Figure 9:
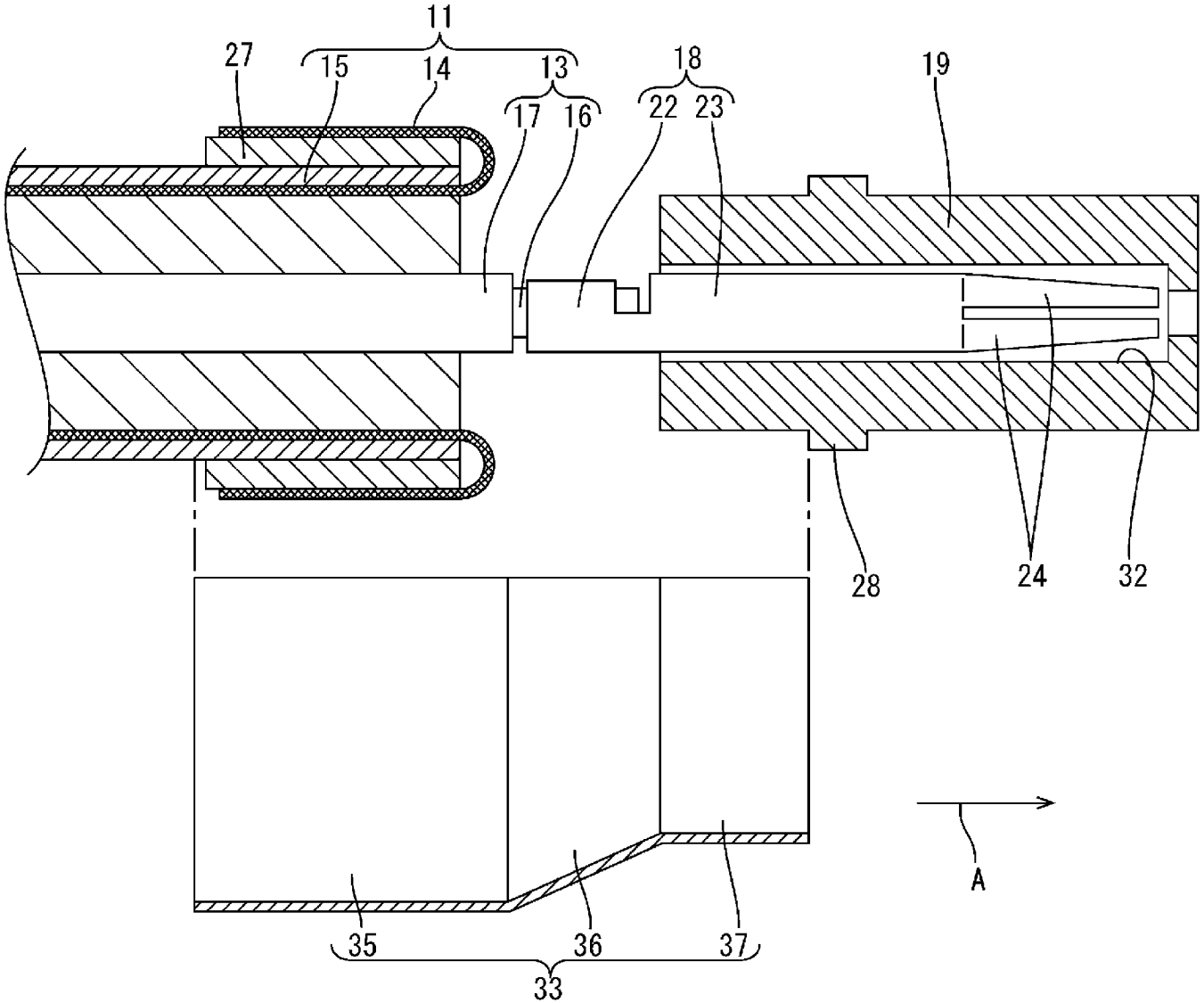
FIG. 9 is a section showing a step of crimping a rear outer conductor to the braided wire and the dielectric.

As shown in FIGS. 2 and 9, the rear outer conductor 33 is formed by press-working a metal plate material into a predetermined shape. An arbitrary metal such as copper, copper alloy, aluminum or aluminum alloy can be selected as a metal constituting the rear outer conductor 33 according to need. The rear outer conductor 33 includes a shield connecting portion 35 to be crimped to the braided wire 14 folded on the sleeve 27 from outside, a rear tube portion 36 connected in front of the shield connecting portion 35 for surrounding the outer peripheries of the coated wires 13 exposed from the braided wire 14, and a dielectric crimping portion 37 connected in front of the rear tube portion 36 and to be crimped to the dielectric 19 at a position near the rear end part of the dielectric 19 from outside.

The rear outer conductor 33 is crimped to the outer periphery of the braided wire 14 and crimped to the dielectric 19 at the position near the rear end part of the dielectric 19 from outside with both left and right side edges butted against each other. The dielectric crimping portion 37 is crimped to a part of the dielectric 19 behind the flange 28. A front end part of the dielectric crimping portion 37 comes into contact with the flange 28 from behind, whereby the rear outer conductor 33 and the dielectric 19 can be positioned in the front-rear direction.

An outer diameter of the shield connecting portion 35 is set to be larger than that of the dielectric crimping portion 37 with the rear outer conductor 33 crimped to the outer periphery of the braided wire 14 and crimped to the dielectric 19 at the position near the rear end part of the dielectric 19. The rear tube portion 36 located between the shield connecting portion 35 and the dielectric crimping portion 37 is formed into a shape reduced in diameter toward the front side.

[Front Outer Conductor 34]

As shown in FIG. 2, the front outer conductor 34 is formed by press-working a metal plate material into a predetermined shape. An arbitrary metal such as copper, copper alloy, aluminum or aluminum alloy can be selected as a metal constituting the front outer conductor 34 according to need. The front outer conductor 34 includes a front tube portion 38 (example of a tube portion) for surrounding the outer periphery of the dielectric 19 and a rear outer conductor locking portion 39 connected behind the front tube portion 38 and to be crimped onto the dielectric crimping portion 37 crimped to a part of the dielectric 19 near the rear end part. A front end part of the front tube portion 38 is formed to extend further forward than the front end part of the dielectric 19. The rear outer conductor locking portion 39 is crimped onto the dielectric crimping portion 37 of the rear outer conductor 33 behind the flange 28 of the dielectric 19. The rear outer conductor locking portion 39 has a smaller diameter than the front tube portion 38.

[Manufacturing Process of Female Connector Structure 10]

Next, an example of a manufacturing process of the female connector structure 10 according to this embodiment is described. Note that the manufacturing process of the female connector structure 10 is not limited to the following one.

Figure 3:
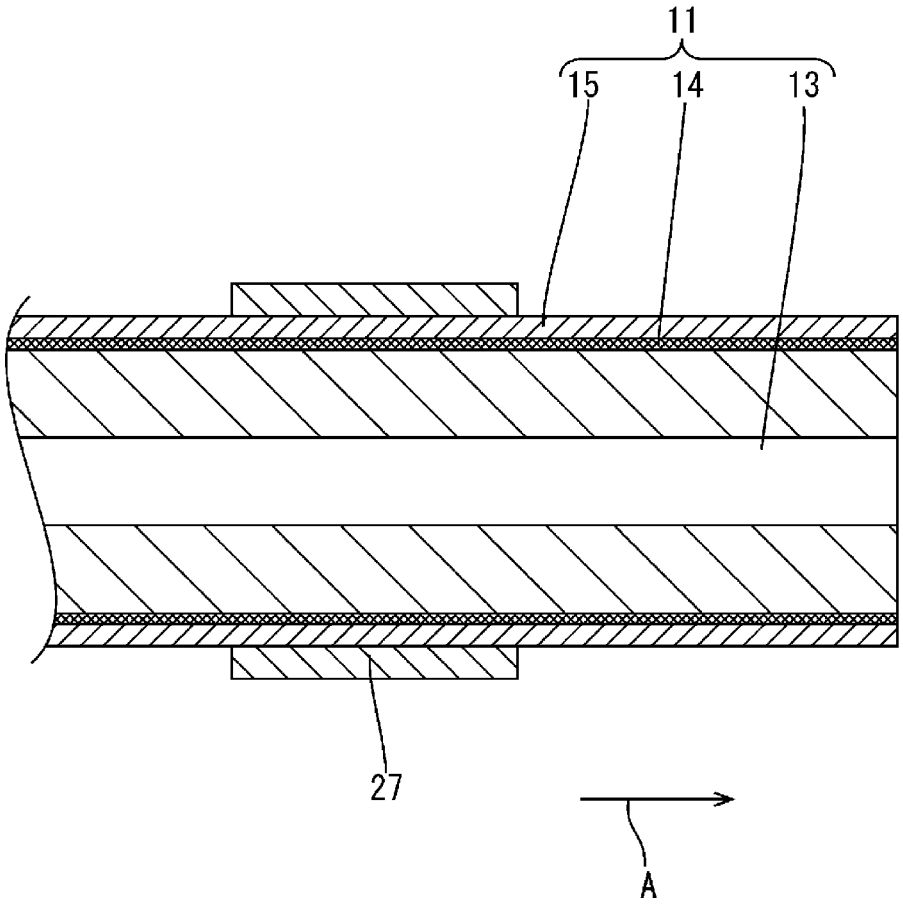
FIG. 3 is a section showing a state where a sleeve is externally fit to a shielded cable in a female connector structure manufacturing process.
Figure 4:
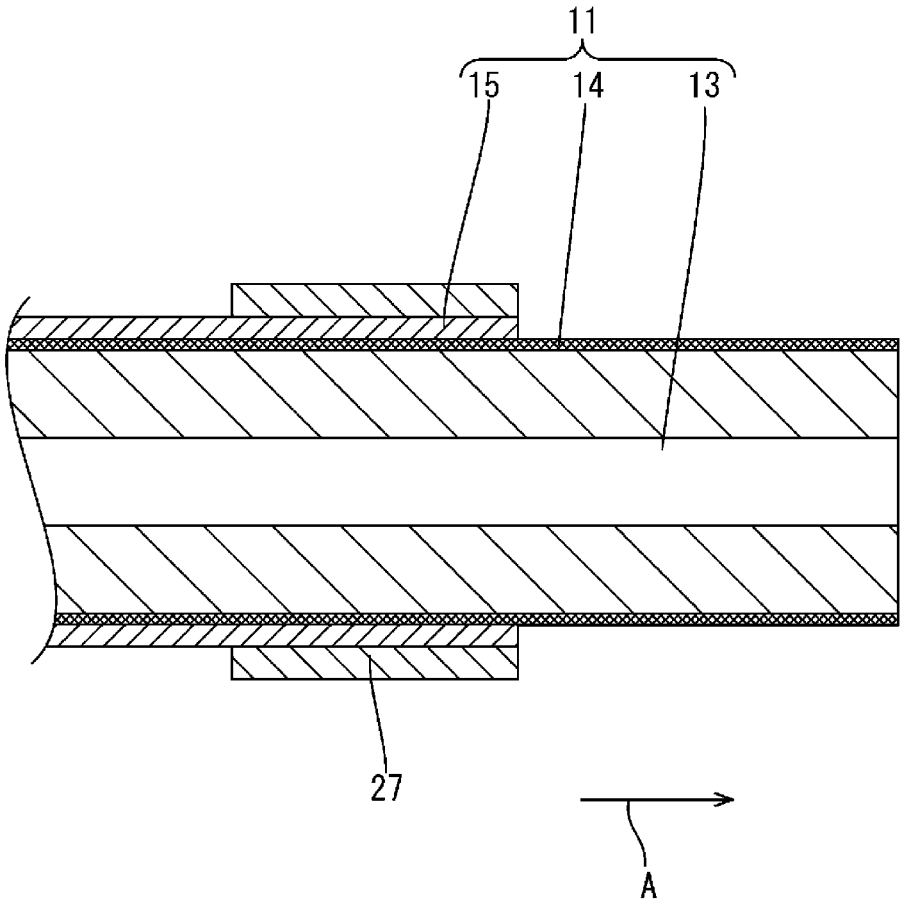
FIG. 4 is a section showing a state where a sheath of the shielded cable is stripped.
Figure 5:
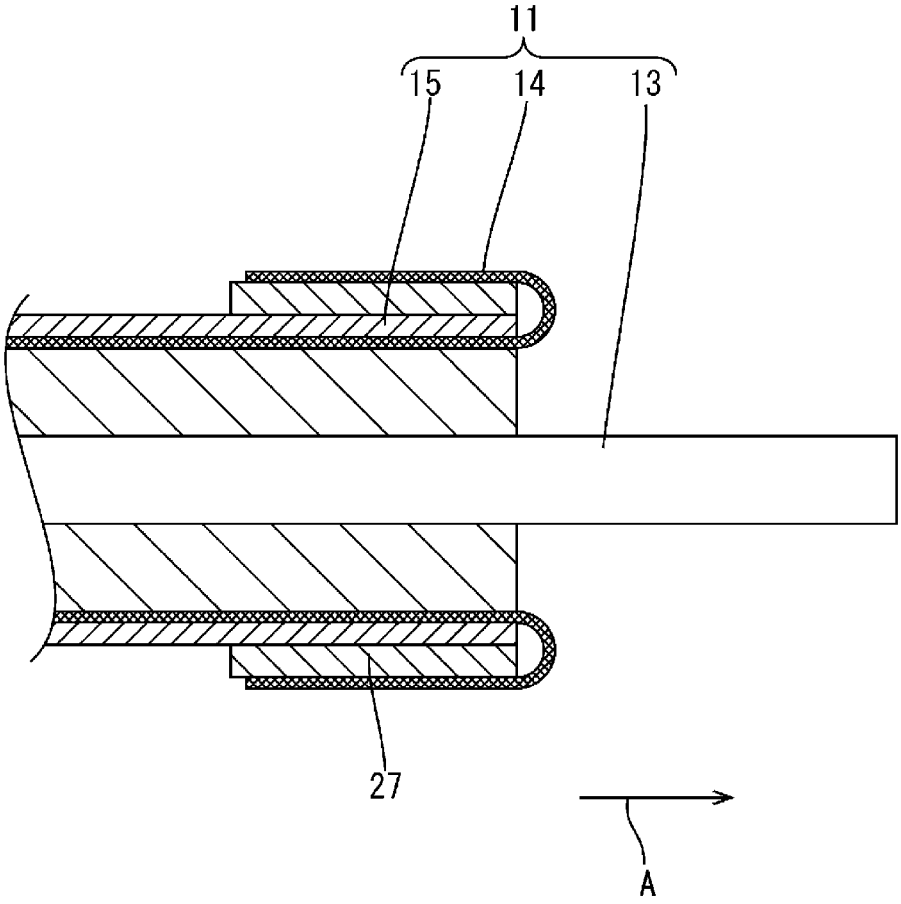
FIG. 5 is a section showing a state where a braided wire is folded on the sleeve.

As shown in FIG. 3, the sleeve 27 is externally fit to the outer periphery of the sheath 15 at a position retracted from an end part of the shielded cable 11 by a predetermined length. As shown in FIG. 4, a part of the sheath 15 in front of a front end part of the sleeve 27 is stripped, thereby exposing the braided wire 14 from the sheath 15. The braided wire 14 is cut to a predetermined length to expose the coated wires 13 from the braided wire 14. The sleeve 27 serves as a mark of a position for the stripping of the sheath 15. As shown in FIG. 5, the braided wire 14 is folded rearward and overlapped on the sleeve 27. By stripping the insulation coatings 17 to a predetermined length on ends of the coated wires 13, the cores 16 are exposed from the insulation coatings 17.

Figure 8:
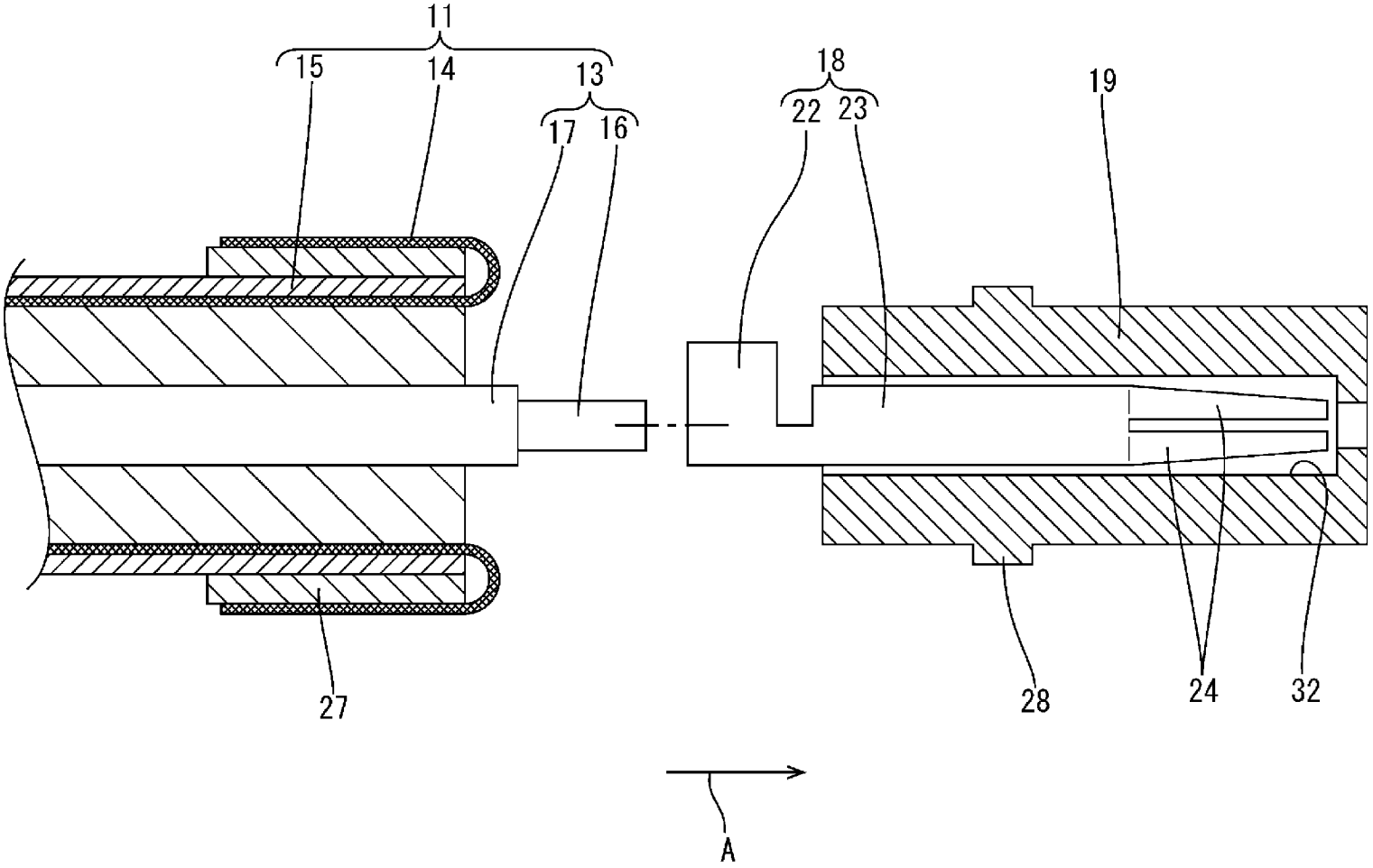
FIG. 8 is a section showing a step of crimping a wire barrel to a core.

As shown in FIG. 6, the female terminals 18 are inserted into the cavities 32 of the dielectric 19 from behind. As shown in FIG. 8, the wire barrel 22 of the female terminal 18 projects rearward from the rear end part of the dielectric 19. By crimping the wire barrel 22 to the outer periphery of the core 16 exposed from the front end part of the insulation coating 17, the female terminal 18 is connected to the end of the coated wire 13 (see FIG. 9).

As shown in FIG. 9, the shield connecting portion 35 of the rear outer conductor 33 is crimped to the braided wire 14 folded on the sleeve 27 from outside. Further, the dielectric crimping portion 37 of the rear outer conductor 33 is crimped to the part of the dielectric 19 behind the flange 28 from outside.

A step of crimping the shield connecting portion 35 to the braided wire 14 and a step of crimping the dielectric crimping portion 37 to the dielectric 19 may be performed in the same step. Further, the step of crimping the shield connecting portion 35 to the braided wire 14 and the step of crimping the dielectric crimping portion 37 to the dielectric 19 may be separately performed. For example, the dielectric crimping portion 37 may be crimped to the dielectric 19 after the shield connecting portion 35 is first crimped to the braided wire 14 or the shield connecting portion 35 may be crimped to the braided wire 14 after the dielectric crimping portion 37 is first crimped to the dielectric 19.

Figure 10:
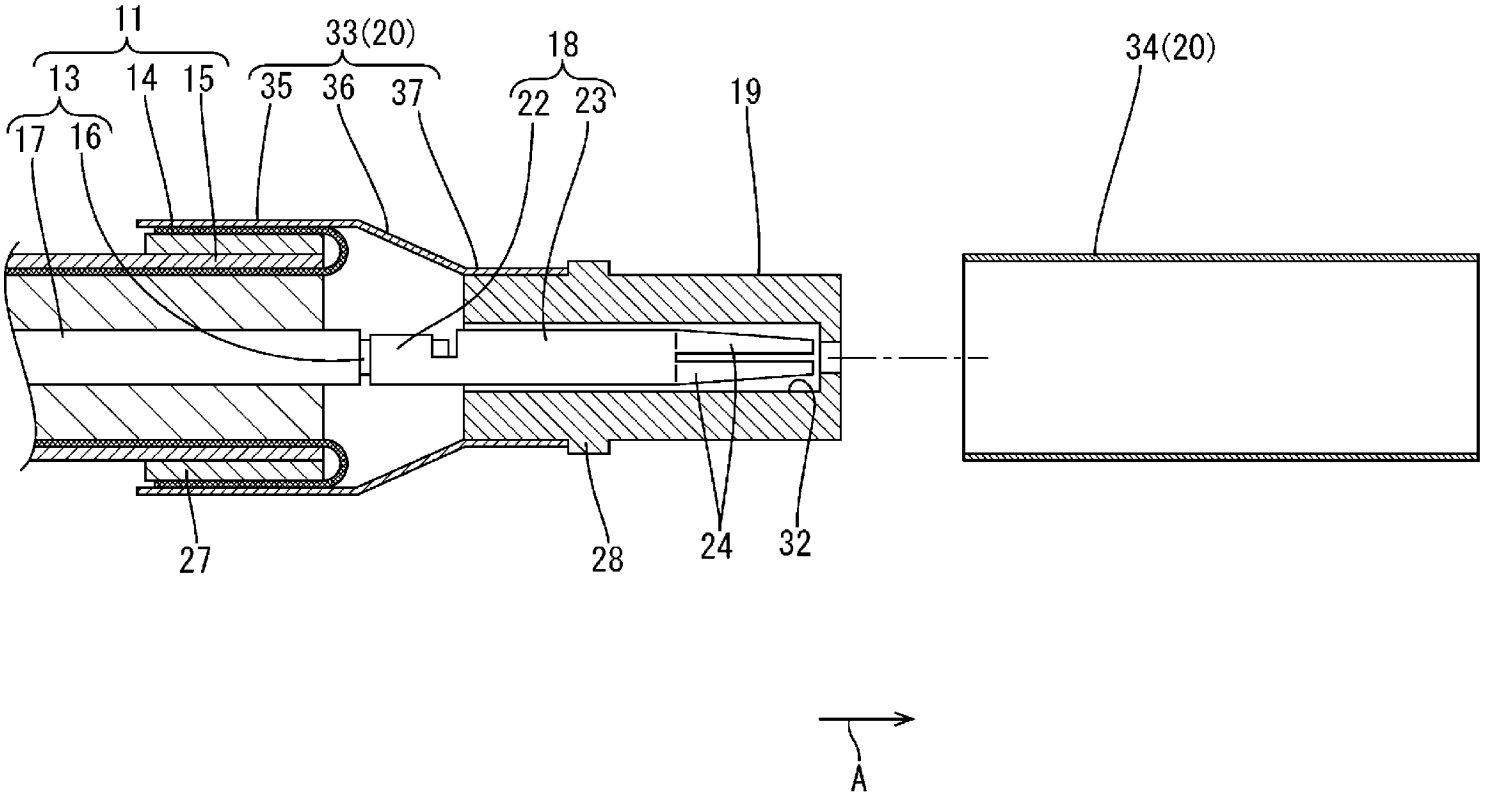
FIG. 10 is a section showing a step of crimping a front outer conductor to the rear outer conductor.

The front outer conductor 34 is formed into a tubular shape. As shown in FIG. 10, the front outer conductor 34 formed into a tubular shape is assembled with the dielectric 19 from the front of the dielectric 19. The rear outer conductor locking portion 39 of the front outer conductor 34 is crimped to the dielectric crimping portion 37 of the rear outer conductor 33 crimped to the dielectric 19 from outside. In the above way, the female connector structure 10 is completed (see FIGS. 1 and 2).

[Functions and Effects of First Embodiment]

Next, functions and effects of this embodiment are described. According to this embodiment, the female connector structure 10 is provided with the shielded cable 11 configured such that the outer peripheries of the coated wires 13 each including the core 16 extending in the front-rear direction and the insulation coating 17 surrounding the outer periphery of the core 16 are surrounded by the braided wire 14, the female terminals 18 each including the wire barrel 22 to be connected to the core 16 and the connecting tube portion 23 continuous with the wire barrel 22 and to be connected to the mating terminal, the insulating dielectric 19 for surrounding at least the outer peripheries of the connecting tube portions 23 of the female terminals 18, the rear outer conductor 33 including the shield connecting portion 35 to be electrically connected to the braided wire 14 and the dielectric crimping portion 37 to be crimped to at least a part of the dielectric 19 from outside, and the front outer conductor 34 including the front tube portion 38 for surrounding the outer periphery of the dielectric 19 and the rear outer conductor locking portion 39 to be locked to at least a part of the dielectric crimping portion 37 from outside.

Further, a manufacturing method of the female connector structure 10 disclosed in this specification includes a step of the exposing the cores 16 by stripping the insulation coatings 17 of the shielded cable 11 configured such that the outer peripheries of the coated wires 13 each including the core 16 extending in the front-rear direction and the insulation coating 17 surrounding the outer periphery of the core 16 are surrounded by the braided wire 14, a step of arranging the female terminals 18 in the insulating dielectric 19 with the wire barrels 22 exposed, a step of connecting the wire barrels 22 of the female terminals 18 to the cores 16 exposed from the insulation coatings 17, a step of connecting the rear outer conductor 33 to the braided wire 14, a step of crimping the dielectric crimping portion 37 of the rear outer conductor 33 to at least a part of the dielectric 19 from outside, a step of accommodating the dielectric 19 inside the front outer conductor 34 and a step of locking the rear outer conductor locking portion 39 provided in the front outer conductor 34 to at least a part of the dielectric crimping portion 37.

According to the above configuration, the rear and front outer conductors 33, 34 are connected by crimping the dielectric crimping portion 37 of the rear outer conductor 33 to at least a part of the dielectric 19 and locking the rear outer conductor locking portion 39 to at least a part of the dielectric crimping portion 37. In this way, the rear and front outer conductors 33, 34 can be connected without welding. As a result, the rear and front outer conductors 33, 34 can be connected without being heated, wherefore the occurrence of troubles in the dielectric 19 due to heat can be suppressed.

Second Embodiment

Figure 11:
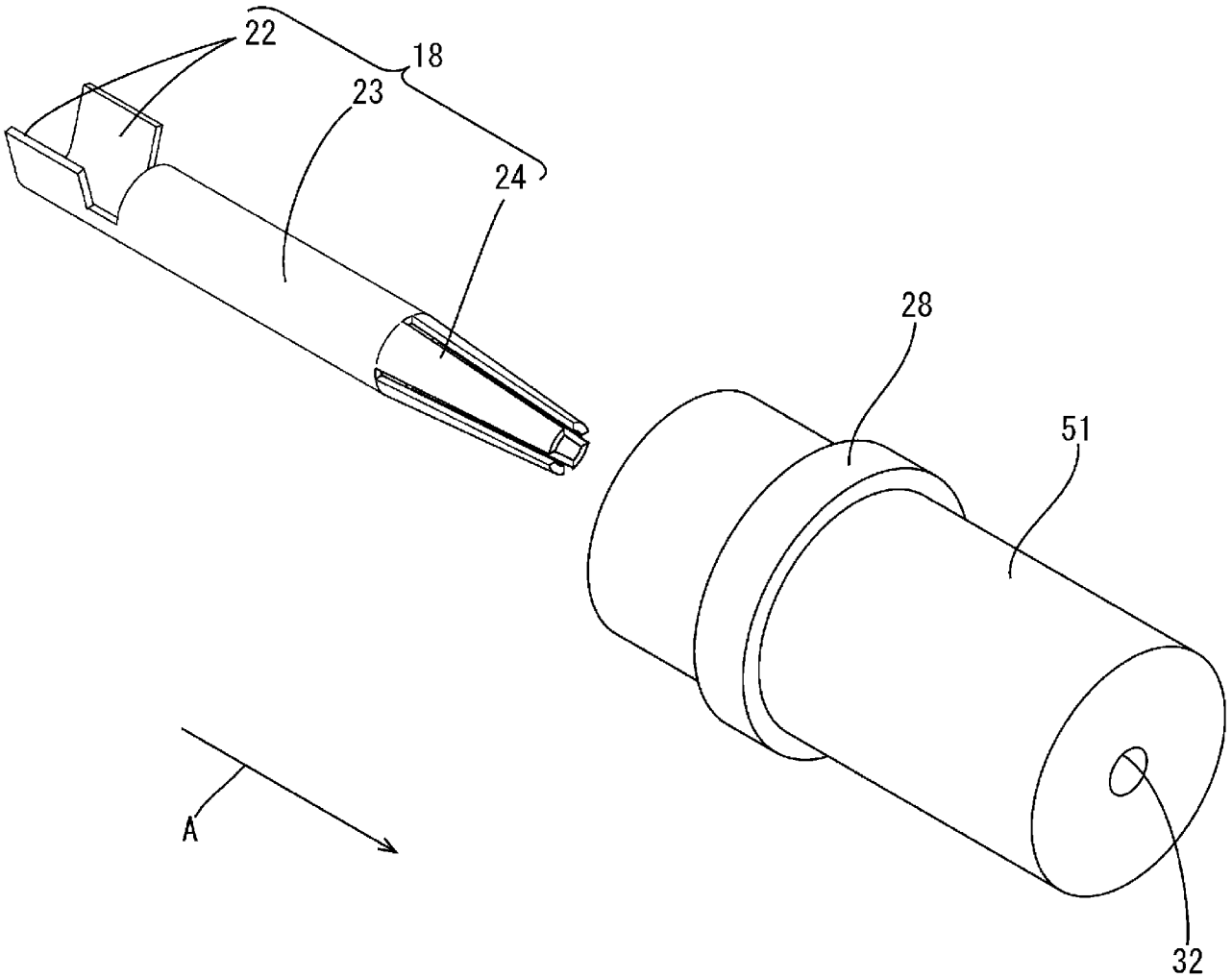
FIG. 11 is a perspective view showing a step of inserting a female terminal into a dielectric in a female connector structure according to a second embodiment.
Figure 12:
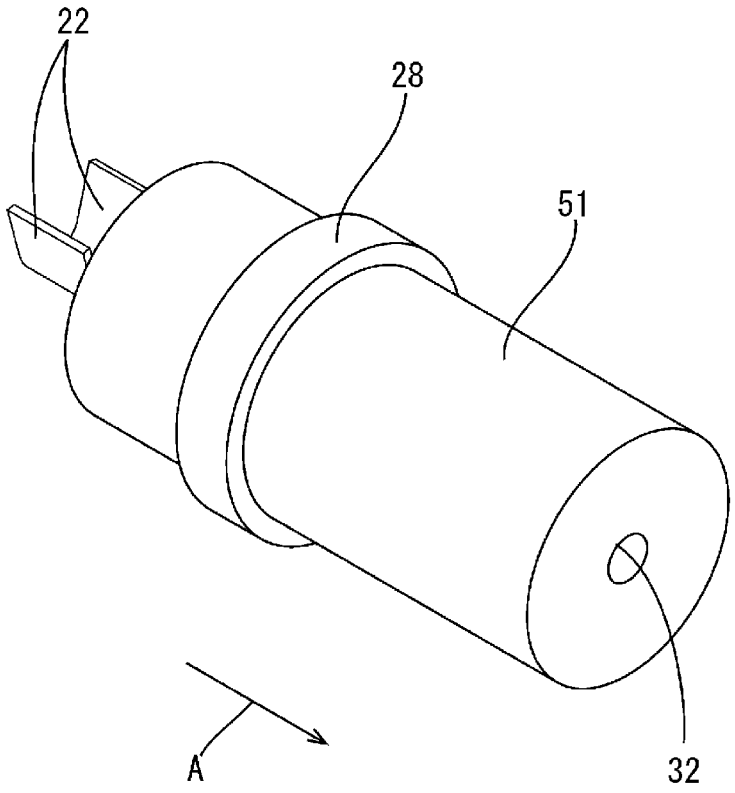
FIG. 12 is a perspective view showing a state where the female terminal is inserted in the dielectric.
Figure 13:
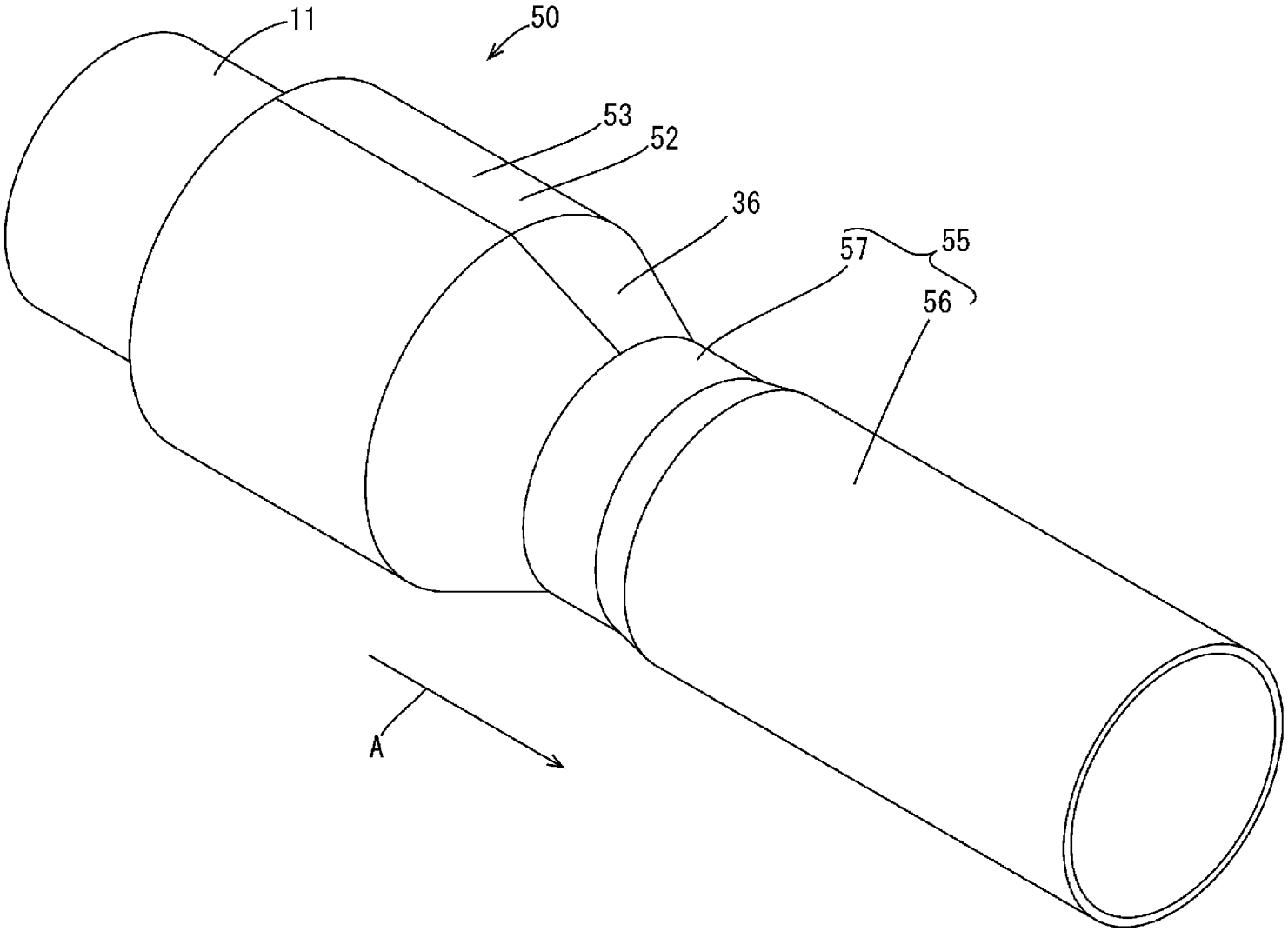
FIG. 13 is a perspective view showing the female connector structure according to the second embodiment.

Next, a second embodiment of the technique disclosed in this specification is described with reference to FIGS. 11 to 13. In a female connector structure 50 according to this embodiment, a dielectric 51 has a substantially hollow cylindrical shape extending in a front-rear direction. The dielectric 51 is formed with one cavity 32 open forward and rearward. One female terminal 18 is accommodated in the cavity 32.

A rear outer conductor 52 includes a shield connecting portion 53 having a substantially hollow cylindrical shape and a dielectric crimping portion (not shown) formed coaxially with the shield connecting portion 53 and having a substantially hollow cylindrical shape.

A front outer conductor 55 includes a front tube portion 56 having a substantially hollow cylindrical shape and a rear outer conductor locking portion 57 formed coaxially with the front tube portion 56 and having a substantially hollow cylindrical shape.

The dielectric 51 according to this embodiment can be effectively applied to the female connector structure 50 including a shielded cable 11 in which one coated wire 13 is disposed in a sheath 15.

Since the other configuration is substantially the same as in the first embodiment, the same members are denoted by the same reference signs and repeated description is omitted.

Third Embodiment

Figure 14:
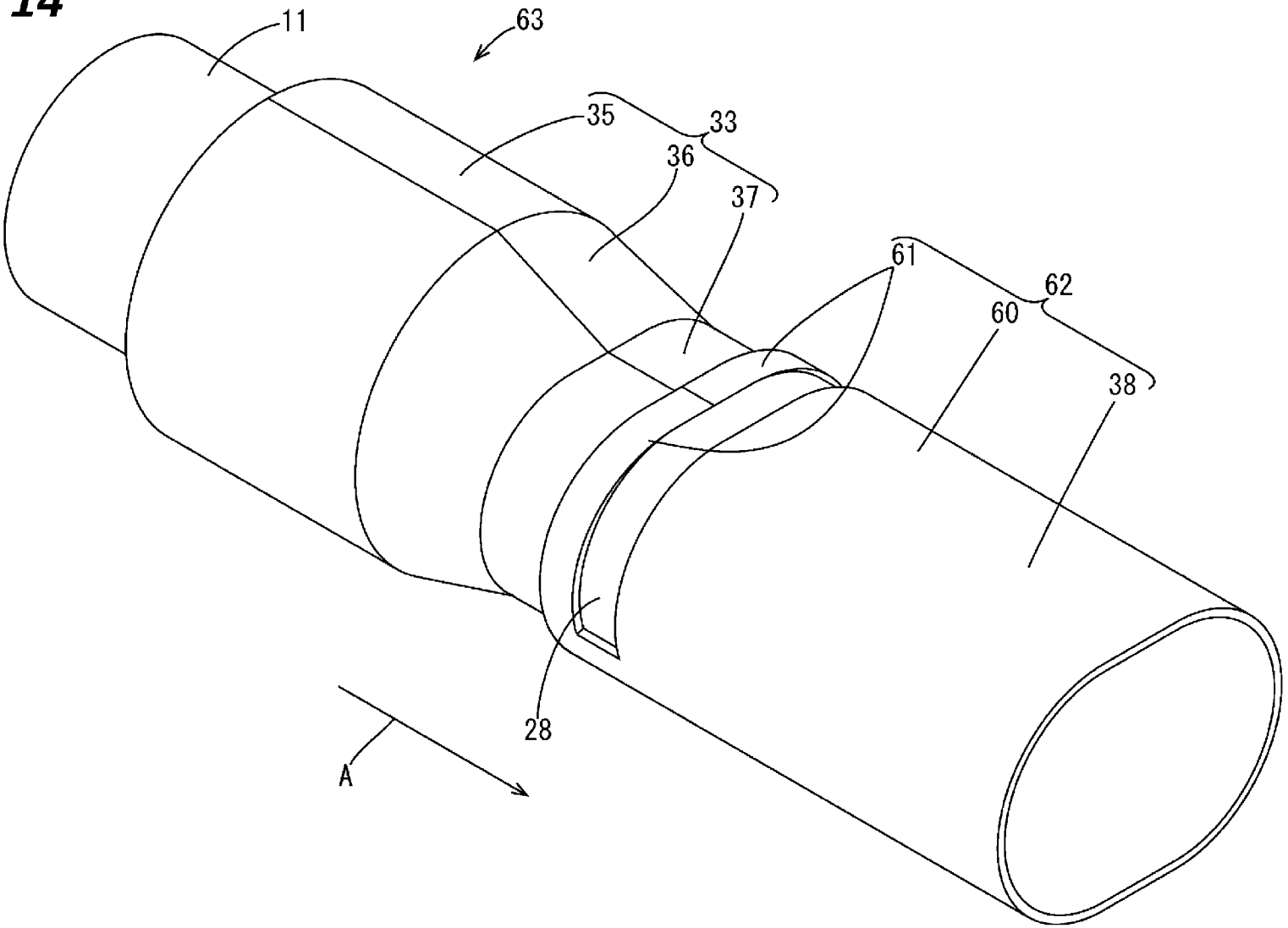
FIG. 14 is a perspective view showing a female connector structure according to a third embodiment.
Figure 15:
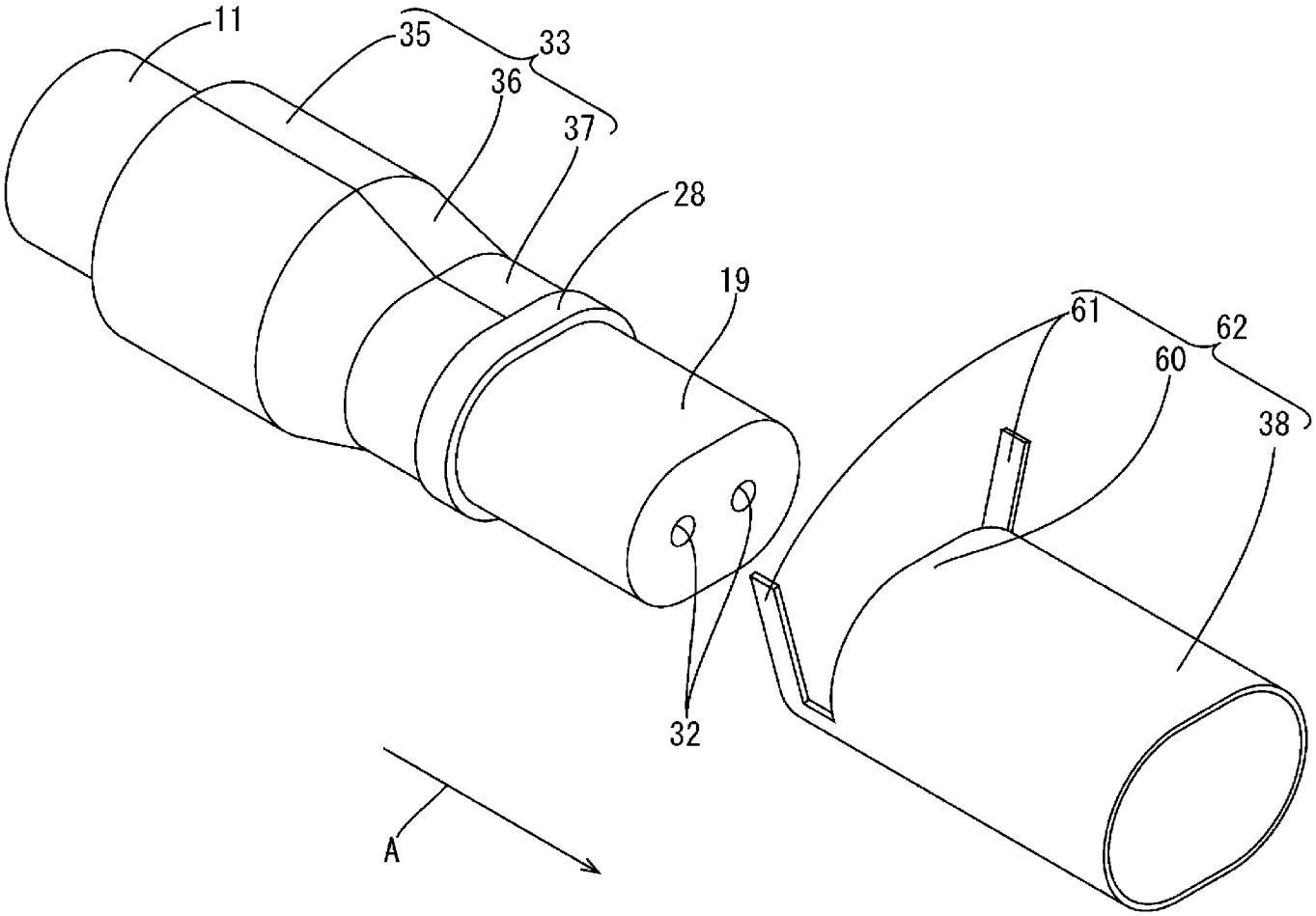
FIG. 15 is a perspective view showing a step of crimping rear outer conductor crimping pieces of a front outer conductor to a rear outer conductor.

Next, a third embodiment of the technique disclosed in this specification is described with reference to FIGS. 14 and 15. In a front outer conductor 62 according to this embodiment, a pair of rear outer conductor crimping pieces 61 to be respectively crimped to wind around the outer periphery of a dielectric crimping portion 37 from left and right sides are provided in a rear end part of a rear outer conductor locking portion 60. End edges of the pair of rear outer conductor crimping pieces 61 are butted against each other.

According to the above configuration, a rear outer conductor 33 and the front outer conductor 62 can be reliably connected.

Since the other configuration is substantially the same as in the first embodiment, the same members are denoted by the same reference signs and repeated description is omitted.

Fourth Embodiment

Figure 16:
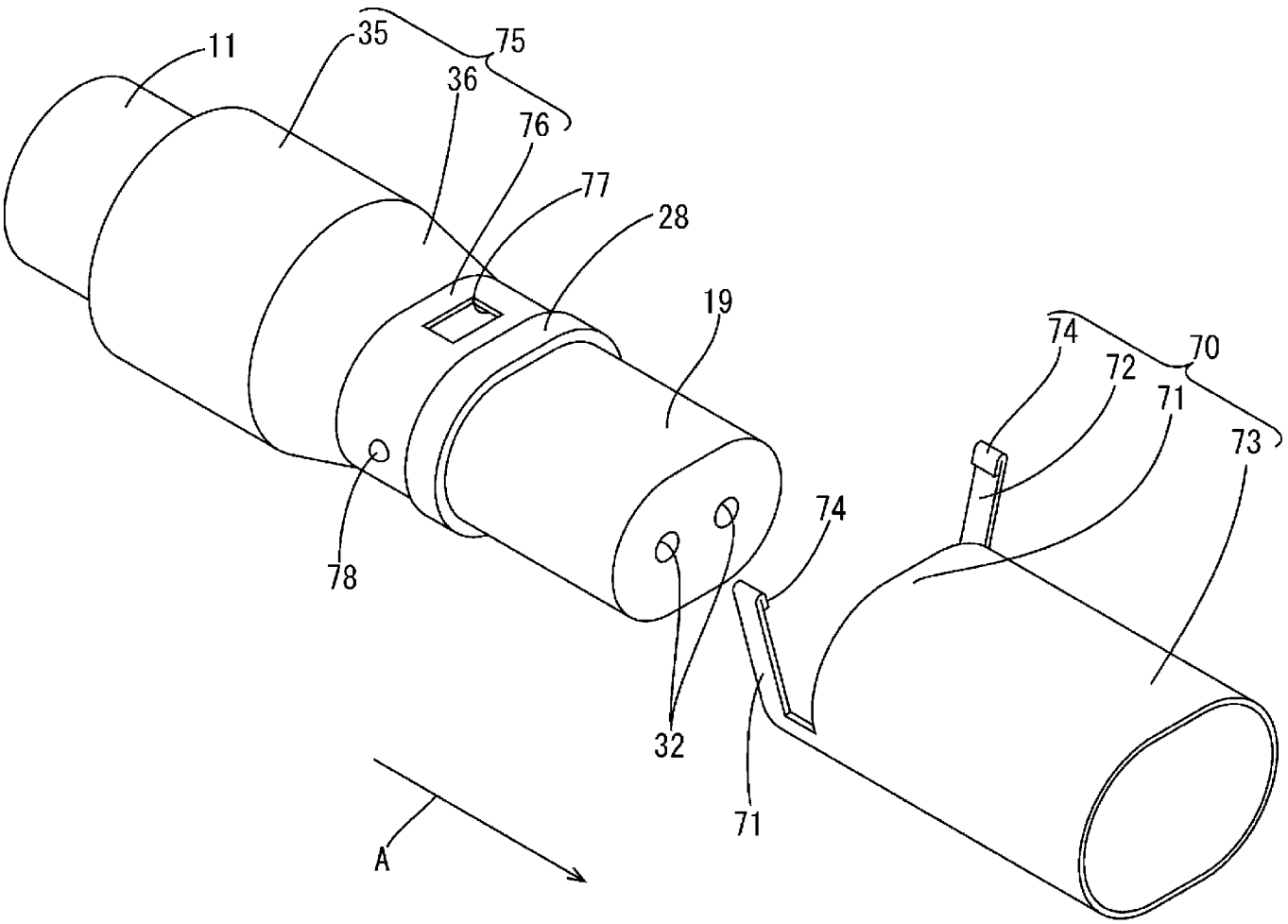
FIG. 16 is a perspective view showing a step of crimping rear outer conductor crimping pieces of a front outer conductor to a rear outer conductor in a female connector structure according to a fourth embodiment.
Figure 17:
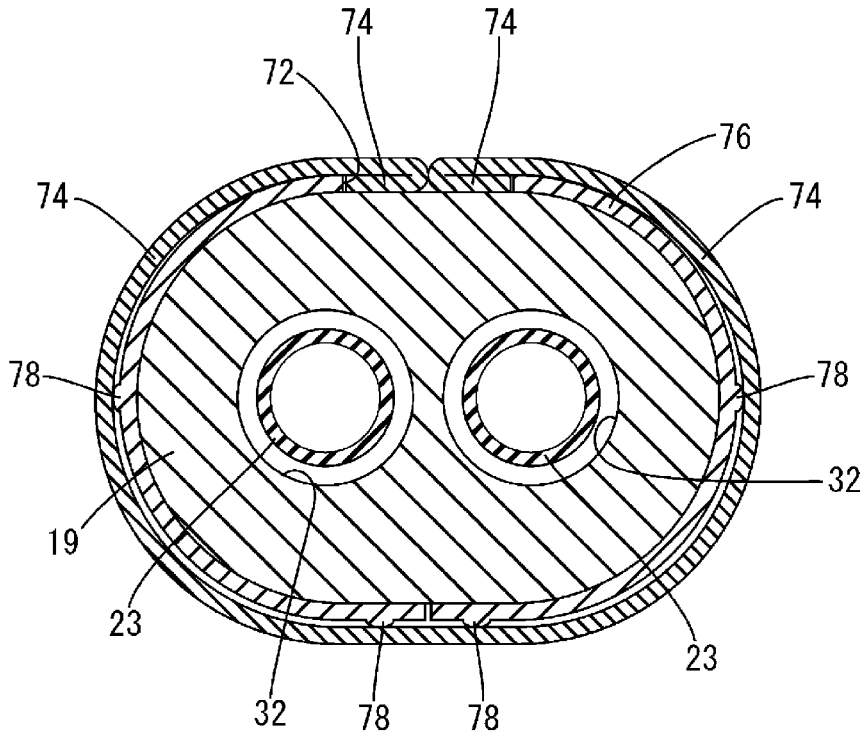
FIG. 17 is a section showing a state where the rear outer conductor crimping pieces of the front outer conductor are crimped to the rear outer conductor.

Next, a fourth embodiment of the technique disclosed in this specification is described with reference to FIGS. 16 and 17. A rear end part of a rear outer conductor locking portion 71 of a front outer conductor 70 according to this embodiment is provided with a pair of rear outer conductor crimping pieces 72. An end part of each of the pair of rear outer conductor crimping pieces 72 is folded radially inwardly of a front tube portion 73 to provide an expansion suppressing portion 74. The expansion suppressing portions 74 are formed to project toward the dielectric crimping portion 76 with the rear outer conductor crimping pieces 72 crimped to wind around the outer conductor of a dielectric crimping portion 76 of a rear outer conductor 75.

The dielectric crimping portion 76 of the rear outer conductor 75 is formed with a recess 77 at a position corresponding to the expansion suppressing portions 74. The recess 77 has a rectangular shape when viewed from above. With the rear outer conductor crimping pieces 72 crimped to the outer periphery of the dielectric crimping portion 76, the expansion suppressing portions 74 are fit in the recess 77 from above. In this way, the expansion suppressing portions 74 are locked to an inner wall of the recess 77 in a circumferential direction of a dielectric 19. In this way, the expansion deformation of the rear outer conductor crimping pieces 72 (rear outer conductor locking portion 71) is suppressed.

Further, a plurality of (four in this embodiment) connecting protrusions 78 projecting outward are formed at intervals in a circumferential direction of the dielectric crimping piece 76 on the outer surface of the dielectric crimping portion 76. With the rear outer conductor crimping pieces 72 crimped to the outer periphery of the dielectric crimping portion 76, the connecting protrusions 78 are in contact with the inner surfaces of the rear outer conductor crimping pieces 72. In this way, the rear and front outer conductors 75, 70 can be electrically connected. As a result, the electrical connection reliability of the rear and front outer conductors 75, 70 can be improved.

Since the other configuration is substantially the same as in the third embodiment, the same members are denoted by the same reference signs and repeated description is omitted.

Fifth Embodiment

Figure 18:
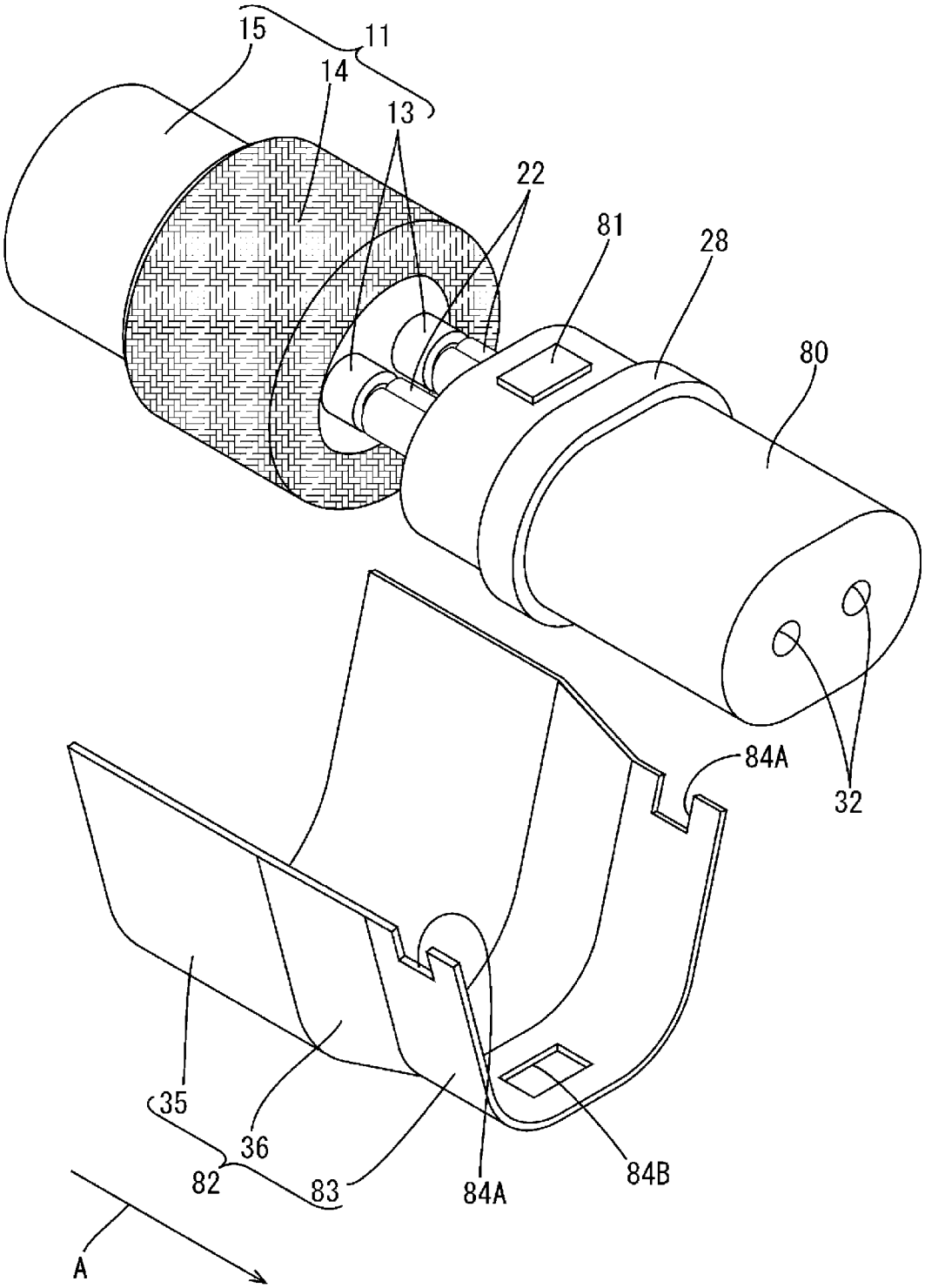
FIG. 18 is a perspective view showing a step of crimping a rear outer conductor to a braided wire and a dielectric in a female connector structure according to a fifth embodiment.
Figure 19:
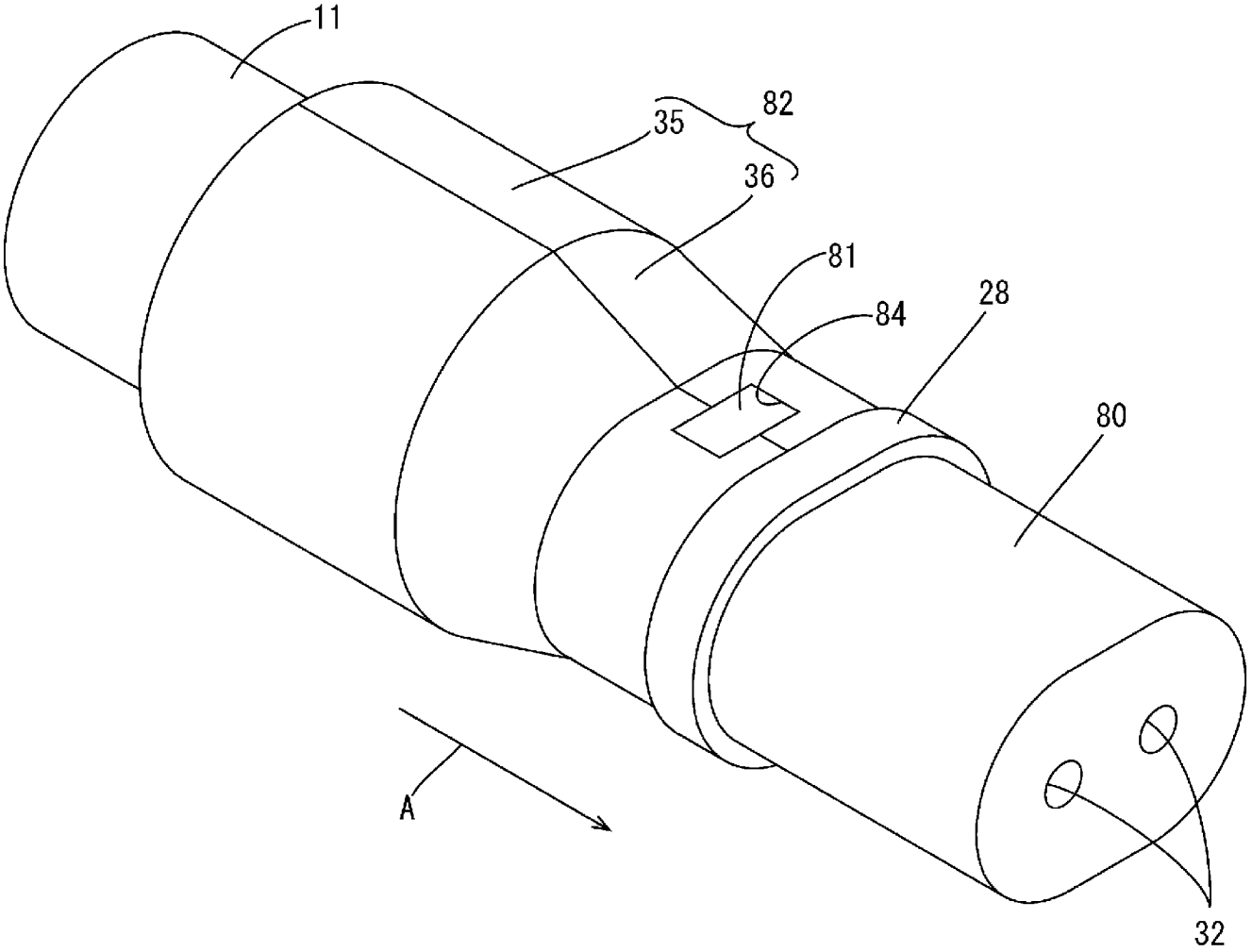
FIG. 19 is a perspective view showing a state where the rear outer conductor is crimped to the braided wire and the dielectric.

Next, a fifth embodiment of the technique disclosed in this specification is described with reference to FIGS. 18 and 19. A locking projection 81 projecting upward is provided at a position behind a flange 28 on the upper surface of a dielectric 80 according to this embodiment. Further, a locking projection (not shown) projecting downward is provided at a position behind the flange 28 on the lower surface of a dielectric 80. The locking projection 81 provided on an upper side of the dielectric 80 and the locking projection provided on a lower side are formed at vertically symmetrical positions. The locking projection 81 on the upper side and the locking projection on the lower side have a rectangular shape when viewed in a vertical direction.

A dielectric crimping portion 83 of a rear outer conductor 82 is formed with a locking recess 84A at a position corresponding to the locking projection 81 with the dielectric crimping portion 83 crimped to the dielectric 80. The locking recess 84A is formed in an upper part of the dielectric crimping portion 83 with both left and right side edges of the rear outer conductor 82 butted against each other. The locking recess 84A has a rectangular shape when viewed from above. The inner shape of the locking recess 84A is the same as or slightly larger than the outer shape of the locking projection 81. With the dielectric crimping portion 83 crimped to the dielectric 80, the locking projection 81 is fit in the locking recess 84A. The projecting end surface of the locking projection 81 is formed to be flush with the outer surface of the dielectric crimping portion 83 with the dielectric crimping portion 83 crimped to the dielectric 80.

The dielectric crimping portion 83 of the rear outer conductor 82 is formed with a locking recess 84B at a position corresponding to the locking projection formed on the lower side of the dielectric 80 with the dielectric crimping portion 83 crimped to the dielectric 80. The locking recess 84B has a rectangular shape when viewed from below. The inner shape of the locking recess 84B is the same as or slightly larger than the outer shape of the locking projection formed on the lower side of the dielectric 80. With the dielectric crimping portion 83 crimped to the dielectric 80, the locking projection formed on the lower side of the dielectric 80 is fit in the locking recess 84B. The projecting end surface of the locking projection formed on the lower side of the dielectric 80 is formed to be flush with the outer surface of the dielectric crimping portion 83 with the dielectric crimping portion 83 crimped to the dielectric 80.

Since the other configuration is substantially the same as in the first embodiment, the same members are denoted by the same reference signs and repeated description is omitted.

According to the above configuration, the relative positional accuracy of the rear outer conductor 82 and the dielectric 80 can be improved by fitting the locking projection 81 formed on the upper side of the dielectric 80 and the locking recess 84R and fitting the locking projection formed on the lower side of the dielectric 80 and the locking recess 84B.

Other Embodiments

The technique disclosed in this specification is not limited to the above described and illustrated embodiments. For example, the following embodiments are also included in the technical scope of the technique disclosed in this specification.

(1) The shielded cable may include three or more coated wires.

(2) An arbitrary material such as a metal foil or a resin tape having a metal foil adhered thereto can be appropriately selected for a shield layer without being limited to the braided wire 14.

(3) The sheath may be omitted.

(4) The braided wire 14 exposed by stripping the sheath may not be folded on the end of the sheath.

(5) The braided wire 14 and the shield connecting portion 35 may be electrically connected by crimping a crimping member formed separately from the rear outer conductor 33 to the shield connecting portion from outside the shield connecting portion with the shield connecting portion 35 externally fit to the outer periphery of the braided wire 14.

(6) The connector structure may be a male connector structure including male terminal(s).

(7) In the fourth embodiment, connecting protrusions projecting toward the dielectric crimping portion 76 may be provided on the inner surfaces of the rear outer conductor crimping pieces 72.

(8) In the fifth embodiment, the dielectric 80 may be provided with locking recesses and the dielectric crimping portion may be provided with locking projections. Further, one, three or more locking recesses and one, three or more locking projections may be provided.

LIST OF REFERENCE NUMERALS

10, 50, 63: female connector structure (example of connector structure)
11: shielded cable
12: female connector
13: coated wire
14: braided wire (example of shield portion)
15: sheath
16: core
17: insulation coating
18: female terminal (example of inner conductor)
19, 51, 80: dielectric
20: outer conductor
22: wire barrel (example of core connecting portion)
23: connecting tube portion (example of connecting portion)
24: resilient contact piece
27: sleeve

28: flange
32: cavity
33, 52, 75, 82: rear outer conductor
34, 55, 62, 70: front outer conductor
35, 53: shield connecting portion
36: rear tube portion
37, 54, 76, 83: dielectric crimping portion
38, 56, 73: front tube portion (example of tube portion)
39, 57, 60, 71: rear outer conductor locking portion
61, 72: rear outer conductor crimping piece
74: expansion suppressing portion
77: recess
78: connecting protrusion
81: locking projection
84A, 84B: locking recess

What is claimed is:

1. A connector structure, comprising:

a shielded cable configured such that an outer periphery of a coated wire including a core extending in a front-rear direction and an insulation coating surrounding an outer periphery of the core is surrounded by a shield portion;

an inner conductor including a core connecting portion to be connected to the core and a connecting portion continuous with the core connecting portion and to be connected to a mating terminal;

an insulating dielectric configured to surround at least an outer periphery of the connecting portion of the inner conductor;

a rear outer conductor including a shield connecting portion to be electrically connected to the shield portion and a dielectric crimping portion to be crimped to at least a part of the dielectric from outside; and a front outer conductor including a tube portion configured to surround an outer periphery of the dielectric and a rear outer conductor locking portion configured to lock at least a part of the dielectric crimping portion from outside, wherein the rear outer conductor locking portion has a smaller diameter than the tube portion.

2. The connector structure of claim 1, wherein the rear outer conductor locking portion includes a rear outer conductor crimping piece to be crimped to wind around an outer periphery of the dielectric crimping portion.

3. The connector structure of claim 2, wherein:

the rear outer conductor locking portion is provided with an expansion suppressing portion projecting toward the dielectric crimping portion with the rear outer conductor locking portion crimped to the outer periphery of the dielectric crimping portion, and the expansion suppressing portion is fit into a recess provided in the dielectric crimping portion and locked to an inner wall of the recess in a circumferential direction of the dielectric.

4. The connector structure of claim 1, wherein one of the rear outer conductor locking portion and the dielectric crimping portion is provided with a connecting protrusion projecting toward the other.

5. The connector structure of claim 1, wherein a locking projection provided on one of the dielectric and the dielectric crimping portion and a locking recess provided in the other are fit with the dielectric crimping portion crimped to the dielectric.

6. A connector structure manufacturing method, comprising:

exposing a core by stripping a front end part of an insulation coating of a shielded cable configured such that an outer periphery of a coated wire including the core extending in a front-rear direction and the insulation coating surrounding an outer periphery of the core is surrounded by a shield portion;

arranging an inner conductor in an insulating dielectric with a core connecting portion exposed;

connecting the core connecting portion of the inner conductor to the core exposed from the insulation coating;

connecting a rear outer conductor to the shield portion;

crimping a dielectric crimping portion of the rear outer conductor to at least a part of the dielectric from outside;

accommodating the dielectric inside a front outer conductor; and locking a rear outer conductor locking portion provided on the front outer conductor to at least a part of the dielectric crimping portion, wherein the rear outer conductor locking portion has a smaller diameter than the tube portion.

* * * * *